US008109195B1

(12) United States Patent
Spence

(10) Patent No.: US 8,109,195 B1
(45) Date of Patent: Feb. 7, 2012

(54) GAS VENTING SYSTEM FOR FIREARMS

(76) Inventor: Jeffery D. Spence, Linden, TN (US)

( * ) Notice: Subject to any disclaimer, the term of this patent is extended or adjusted under 35 U.S.C. 154(b) by 0 days.

(21) Appl. No.: 12/882,486

(22) Filed: Sep. 15, 2010

Related U.S. Application Data

(60) Provisional application No. 61/328,285, filed on Apr. 27, 2010.

(51) Int. Cl.
*F41A 5/24* (2006.01)

(52) U.S. Cl. ..... 89/193

(58) Field of Classification Search ..... 89/191.01–193
See application file for complete search history.

(56) References Cited

U.S. PATENT DOCUMENTS

| | | | | |
|---|---|---|---|---|
| 4,244,273 | A * | 1/1981 | Langendorfer et al. | 89/193 |
| 4,765,224 | A | 8/1988 | Morris | |
| 5,272,956 | A * | 12/1993 | Hudson | 89/128 |
| 5,351,598 | A * | 10/1994 | Schuetz | 89/185 |
| 2008/0276797 | A1 * | 11/2008 | Leitner-Wise | 89/191.01 |
| 2011/0023700 | A1 * | 2/2011 | Herring | 89/193 |

* cited by examiner

*Primary Examiner* — Troy Chambers
(74) *Attorney, Agent, or Firm* — Luedeka, Neely & Graham, PC

(57) ABSTRACT

A gas operated firearm having a gas venting system which configures the carrier key and the gas tube so that a substantial portion of the recoil gas is vented from the gas tube into the cavity defined by a hand guard to reduce fouling and high temperatures associated with conventional venting systems which route gases into the receiver.

3 Claims, 2 Drawing Sheets

GAS VENTING SYSTEM FOR FIREARMS

CROSS-REFERENCE TO RELATED APPLICATION

This application claims priority to U.S. Provisional Application No. 61/328,285 filed Apr. 27, 2010, and entitled "Hybrid Direct Impingement System allows for a cooler/cleaner upper receiver and allows the gas tube to be cleaned in the currently used AR-15/AR-10 class of weapons," incorporated by reference herein in its entirety.

FIELD

The present disclosure relates to the field of gas operated firearms. More particularly, the disclosure relates to a gas venting system for automatic weapons of the type having a carrier key and a gas tube, which configures the carrier key and the gas tube so that a substantial portion of the recoil gas is vented from the gas tube into the cavity defined by the hand guard.

BACKGROUND

Gas operated firearms, particularly automatic weapons such as the AR-15/AR-10 class of weapons, have a carrier key that receives a flow of gas from a gas tube to operate the receiver to eject a fired cartridge and chamber a new cartridge. The gas tube receives gas from adjacent the muzzle end of the barrel and routes it to the carrier key located adjacent the receiver. In use, the gas can result in high temperature conditions in the receiver and fouling of the receiver caused by powder residue from the gas. Both high temperature and fouling can disadvantageously affect operation of the firearm. Accordingly, improvement is desired.

The disclosure advantageously provides a gas venting system for automatic weapons of the type having a carrier key and a gas tube, which configures the carrier key and the gas tube so that a substantial portion of the recoil gas is vented from the gas tube into the cavity defined by the hand guard. This advantageously reduces receiver temperature and fouling of the receiver associated with operation of the firearm compared to conventional gas venting systems.

SUMMARY

The disclosure relates to an improved gas operated firearm, and to methods for modifying conventional gas operated firearms to provide improved gas operated firearms.

In a preferred embodiment, the firearm includes a barrel, a receiver including a bolt carrier; a bolt carrier key that travels between a forward position and a retracted position during operation of the firearm; a gas tube in flow communication with the barrel; and a hand guard surrounding portions of the barrel and the gas tube.

The gas tube has an exit end located entirely within the hand guard and the bolt carrier key is configured so that the bolt carrier key overlaps the gas tube when the bolt carrier key is in the forward position and the bolt carrier key does not overlap the gas tube when the bolt carrier key is in the retracted position to result in a gap being defined between the bolt carrier key and the exit end of the gas tube when the bolt carrier key is in the retracted position.

The bolt carrier key is urged into the retracted position and retracts the bolt and the bolt carrier when gas is routed from the barrel via the gas tube when a cartridge is fired. A substantial amount of the gas in the gas tube is expelled through the gap and into the hand guard to allow at least a substantial portion of the gas to be expelled within the hand guard and not enter into receiver so as to reduce fouling of the receiver and to reduce receiver temperatures as compared to conventional gas operated firearms in which substantially all of the gas is expelled into the receiver.

In a method according to the disclosure, a conventional firearm is modified by providing a modified or replacement gas tube having an exit end located entirely within the hand guard bolt. Also provided is a modified or replacement carrier key configured to overlap the modified or replacement gas tube when the modified or replacement carrier key is in the forward position.

The modified or replacement carrier key does not overlap the modified or replacement gas tube when the modified or replacement carrier key is in the retracted position to result in a gap being defined between the modified or replacement carrier key and the exit end of the modified or replacement gas tube when the modified or replacement carrier key is in the retracted position.

Firearms provided in accordance with the disclosure have reduced fouling of the receiver, and reduced receiver temperatures as compared to conventional gas operated firearms.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
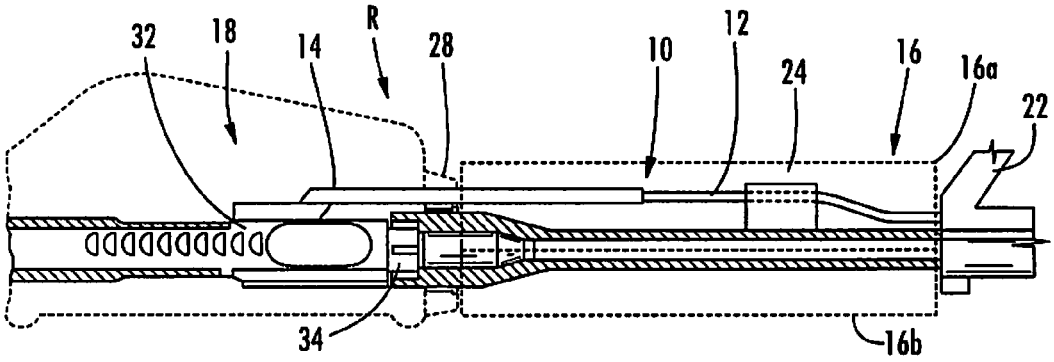
FIG. 1 is a side cross sectional view of a portion of a gas operated firearm in accordance with the disclosure where the bolt carrier is in the forward position immediately after firing a cartridge.

With reference to the drawings, the disclosure relates to gas operated rifle R or other firearm having an improved gas tube and bolt carrier key assembly 10 configured to minimize routing of gas to a receiver area of the rifle, by directing a substantial portion of the recoil gas into a cavity located remote from the receiver. Conventional aspects of a gas operated rifle that are unaffected by the improved assembly 10 may be retained.

Conventional gas operated firearms vent the recoil gas into the receiver area of the firearm, which results in a high receiver temperature and powder residue from the gas coating and fouling the surfaces of the receiver. The high temperatures and fouling are disadvantageous to operation of the firearm, particularly in circumstances of rapid rates of firing. The system 10 according to the disclosure minimizes the introduction of gas into the receiver area, thus avoiding temperature increases and fouling associated with the gas.

In a preferred embodiment, the assembly 10 includes a gas tube 12, a bolt carrier key 14, a hand guard 16, and an upper receiver assembly 18. The structure of the gas tube and bolt carrier assembly 10 desirably vents gases within the hand guard 16 thereby reducing the buildup of heat and used gases within the upper receiver 18.

With reference to FIG. 1, the gas tube 12 includes a forward end in gas flow communication with a muzzle portion of a barrel 20 adjacent a front sight 22. For example, the gas tube 12 passes into the sight 22, with the sight 22 having an interior passage in flow communication with the gas tube 12 and a port of the barrel 20 so that a portion of the gas generated by the firing of a cartridge is routed to the gas tube 12.

The gas tube 12 extends rearwardly from the front sight 22 towards the upper receiver 18 and extends to a point in front of the upper receiver 18 where the gas tube 12 has an open rearward end 12*a*. The gas tube 12 is desirably supported by a gas tube support member 24 supportably mounting the gas tube 12 to the barrel 20. As will be observed, the open rearward end 12*a* of the gas tube is outside of the receiver assembly 18 and within the hand guard 16.

It will be understood that the upper receiver assembly 18 may be combined with a conventional lower receiver assembly of a gas operated firearm to provide a receiver within which cartridges are automatically fed from a magazine and chambered to the rearward end of the barrel 20, with the cartridge being fired and ejected by the cycling operation of the firearm.

Figure 2:
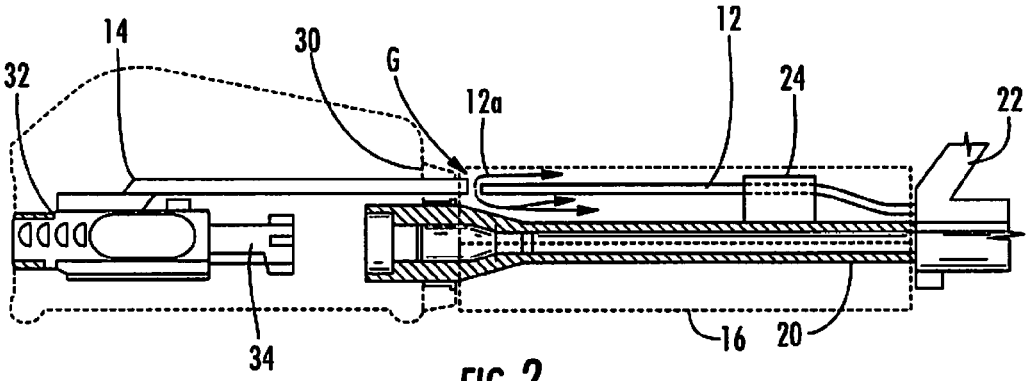
FIG. 2 is a side cross sectional view of the firearm of FIG. 1, where the bolt is in the retracted position after ejecting an empty casing from the cartridge.
Figure 3:
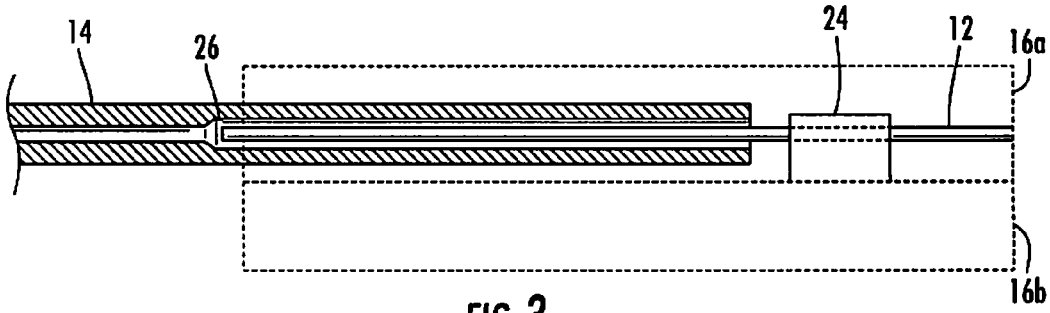
FIG. 3 is a side cross sectional view showing a gas tube in connection with a bolt carrier key in accordance with the disclosure.
Figure 4:
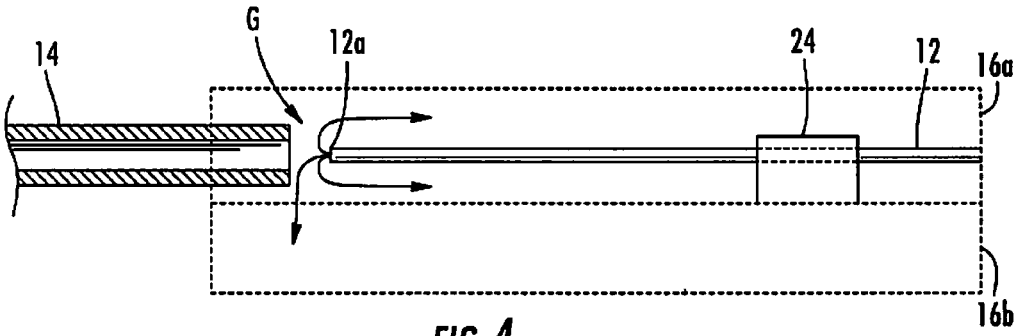
FIG. 4 is a side cross sectional view showing the gas tube separated from the bolt carrier key in accordance with the disclosure.

The bolt carrier key 14 is desirably configured to overlap the open end 12*a* of the gas tube 12 in one orientation (FIGS. 1 and 3) and to separate therefrom in another orientation (FIGS. 2 and 4). The length of the bolt carrier key 14 is preferably from 6-8 inches. The interior diameter of the bolt carrier key tube 14 is preferably larger than the outside diameter of the gas tube 12 enabling the bolt carrier key 14 to overlap the gas tube 12. The interior diameter of the bolt carrier key tube 14 may include a neck 26 (FIG. 3) at a point adjacent the open end 12*a* of the gas tube 12 for reducing the interior diameter of the bolt carrier key 14. It is also understood that the bolt carrier key 14 may have an outer diameter less than the inner diameter of the gas tube 12 so that the gas tube 12 may overlap the bolt carrier key 14.

A barrel nut assembly 28 is configured adjacent the upper receiver 18 and the hand guard 16, and enables installation of the barrel 20 and the hand guard 16 to the receiver, and permits the desired reciprocal sliding action of the key tube 14. If a conventional barrel nut assembly is utilized, it may be modified to accommodate the bolt carrier key 14, or a new barrel nut assembly 28 may be provided that is configured for receiving the bolt carrier key 14. As will be appreciated, the barrel nut assembly 28 includes a barrel nut, a hand guard ring, a spring and a lock washer.

The bolt carrier key 14 extends from a point inside the hand guard 16 rearwardly through an aperture 30 in the upper receiver 18 and the barrel nut assembly 28 before attaching to a bolt carrier 32 within the upper receiver 18. The aperture 30 desirably maintains the position of the bolt carrier key 14 while allowing the bolt carrier key 14 to slide through the aperture 30 such that the bolt carrier key 14 may separate from and thereafter slidingly re-engage and overlap a portion of the gas tube 12 during operation of the rifle R.

The hand guard 16 is preferably configured to surround a portion of the barrel 20 associated with the bolt carrier key 14, and the gas tube 12. The hand guard 16 desirably enables a user to support the barrel 20 without making direct contact with the barrel 20, the carrier key tube 14, or the gas tube 12 which generate heat during use. The hand guard 16 is desirably provided as an upper portion 16*a* and a lower portion 16*b*, which are snap fit together to provide the hand guard 16. Alternatively, the hand guar 16 is a one-piece guard. The use of a one-piece guard is preferred to provide a free-floated barrel configuration in which the barrel does not contact the hand guard.

The upper receiver assembly 18 includes a bolt 34 connected to extend from the bolt carrier 32. The bolt carrier 32 may be a conventional bolt carrier having vent ports, with the ports providing surface area that facilitates cooling of the bolt carrier 32. However, since substantially all of the gas flow provided by the gas tube 12 is vented into the hand guard 16, any ports of the bolt carrier 32 do not serve any substantial venting purpose in the assembly of the disclosure. It will be understood that due to the separation of the bolt carrier key 14 from the gas tube 12 within the hand guard 16, the need for interior ports in the bolt carrier key 14 is avoided, and the same may be eliminated. However, if the key 14 is formed by retrofitting a conventional bolt carrier key and/or a conventional bolt carrier, then the ports of the conventional bolt carrier key and the conventional bolt carrier may be retained for ease of modification.

Returning to FIG. 1, when a cartridge is fired with the rifle R, a highly pressurized gas travels down the length of the barrel 20 behind the bullet of the cartridge. FIG. 1 illustrates the bolt 34 in the forward position immediately after a cartridge has been fired. A portion of gas exits the barrel 20 via the port of the barrel 20 and the associated passage of the front sight 22. The gas travels through the port and passage and into the gas tube 12. While the bolt 34 is still in the forward position, the bolt carrier key 14 preferably overlaps the gas tube 12 (FIG. 3) and the gas pressure acts on the bolt carrier key 14 urging it to travel rapidly toward the receiver assembly 18, retracting the bolt 34, as shown in FIG. 2. Alternatively, the gas tube 12 may overlap the carrier key 14 to provide the same connected/separated relationships. In the event a magazine associated with the receiver assembly 18 contains an additional cartridge, a new cartridge is chambered for firing.

With reference to FIG. 4, when the bolt 34 and the bolt carrier 32 are retracted, the bolt carrier key 14 retracts with the bolt 34 and the bolt carrier 32 causing the bolt carrier key 14 and the gas tube to separate creating a gap G through which gases may be expelled as indicated by the arrows. The gases may be expelled through the gap G located within the hand guard 16, allowing most of the hot gases to be expelled within the hand guard 16 and not enter into the upper receiver 18. The expulsion of the hot gases in the hand guard 16 reduces the heating and buildup caused by traditional expulsion of the gases within the receiver 18, where the bolt 34, bolt carrier 32, and several other important components are located. By expelling the gases in the hand guard 16 as opposed to the upper receiver 18, less fouling occurs and more cartridges may be fired before cleaning is needed. In addition, reduction of the amount of gas entering the receiver 18 also avoids high receiver temperatures associated with conventional gas systems that purposefully route gas into the receiver to operate the rifle R.

After the unused gases have been expelled, the bolt 34 and bolt carrier 32 return to the forward position as illustrated in FIG. 3. The bolt carrier key 14, held in alignment by the aperture 30, slides forward and re-engages the gas tube 12, held in a fixed position by the gas tube support member 24. The overlap between the bolt carrier key 14 and the gas tube 12 allows gas routed through the gas tube 12 from the next cartridge to rapidly act on the bolt carrier key 14 and start the cycle over again, while substantially venting the recoil gases into the hand guard 16 and not into the receiver 18.

A new firearm may be constructed according to the disclosure or, an existing firearm may be modified to include the gas tube and bolt carrier key assembly 10 according to the disclosure. While conventional parts of a gas operated firearm may be modified to provide a firearm according to the disclosure, it is preferred that new parts, namely, a receiver, a barrel nut assembly, a gas tube, and a bolt carrier key be constructed to replace the original receiver, barrel nut assembly, gas tube, and bolt carrier key of the firearm, with the new parts being configured to provide the desired structure of the assembly 10 while being able to be integrated with the original retained structure of the firearm.

It has been observed that firearms configured according to the disclosure have substantially reduced fouling of the receiver after the firing of multiple rounds, such as at least about 200 rounds, as compared to a conventional firearm that routes substantially all of the gas to the receiver.

It has also been observed that firearms according to the disclosure have substantially lower receiver temperatures after the firing of multiple rounds as compared to a conventional firearm that routes substantially all of the gas to the receiver. For example, the temperature of the upper receiver was measured after rapid succession firing of 210 rounds in a firearm according to the disclosure and the same number of the same type of rounds in a conventional firearm as described. The receiver temperature of the conventional firearm was observed to be about 200 degrees Fahrenheit, with the bolt carrier thereof having a temperature of about 180 degrees Fahrenheit. The receiver temperature of a firearm according to the disclosure was observed to be about 150 degrees Fahrenheit, with the bolt carrier thereof having a temperature of about 135 degrees Fahrenheit. Thus, a temperature reduction of about 25 percent was observed.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. In a gas operated firearm of the type having a barrel, a receiver, a bolt carrier, a bolt carrier key that travels between a forward position and a retracted position during operation of the firearm, a gas tube in flow communication with the barrel, and a hand guard surrounding portions of the barrel and the gas tube, the improvement comprising:

a gas tube having an exit end located entirely within the hand guard and a bolt carrier key configured so that the bolt carrier key overlaps the gas tube when the bolt carrier key is in a forward position and the bolt carrier key does not overlap the gas tube when the bolt carrier key is in the retracted position to result in a gap being defined between the bolt carrier key and the exit end of the gas tube when the bolt carrier key is in the retracted position, wherein the bolt carrier key is urged into the retracted position and retracts the bolt and the bolt carrier when gas is routed from the barrel via the gas tube when a cartridge is fired, and wherein a substantial amount of the gas in the gas tube is expelled through the gap and into the hand guard to allow at least a substantial portion of the gas to be expelled within the hand guard and not enter into the receiver so as to reduce fouling of the receiver and to reduce receiver temperatures as compared to conventional gas operated firearms in which substantially all of the gas is expelled into the receiver.

2. A gas operated firearm, comprising:

a barrel, a receiver including a bolt carrier, a bolt carrier key that travels between a forward position and a retracted position during operation of the firearm, a gas tube in flow communication with the barrel;

and a hand guard surrounding portions of the barrel and the gas tube;

wherein the gas tube has an exit end located entirely within the hand guard and the bolt carrier key is configured so that the bolt carrier key overlaps the gas tube when the bolt carrier key is in the forward position and the bolt carrier key does not overlap the gas tube when the bolt carrier key is in the retracted position to result in a gap being defined between the bolt carrier key and the exit end of the gas tube when the bolt carrier key is in the retracted position, wherein the bolt carrier key is urged into the retracted position and retracts the bolt and the bolt carrier when gas is routed from the barrel via the gas tube when a cartridge is fired, and wherein a substantial amount of the gas in the gas tube is expelled through the gap and into the hand guard to allow at least a substantial portion of the gas to be expelled within the hand guard and not enter into the receiver so as to reduce fouling of the receiver and to reduce receiver temperatures as compared to conventional gas operated firearms in which substantially all of the gas is expelled into the receiver.

3. A method of modifying a conventional gas operated firearm of the type having a barrel, a receiver, a bolt carrier, a bolt carrier key that travels between a forward position and a retracted position during operation of the firearm, a gas tube in flow communication with the barrel and having an exit end which extends into the receiver for engaging the carrier key in an overlapping relationship, and a hand guard surrounding portions of the barrel and the gas tube, the method comprising the steps of:

providing a modified or replacement gas tube having an exit end located entirely within the hand guard bolt;

providing a modified or replacement carrier key configured to overlap the modified or replacement gas tube when the modified or replacement carrier key is in the forward position and the modified or replacement carrier key does not overlap the modified or replacement gas tube when the modified or replacement carrier key is in the retracted position to result in a gap being defined between the modified or replacement carrier key and the exit end of the modified or replacement gas tube when the modified or replacement carrier key is in the retracted position.

* * * * *